US011873580B2

(12) United States Patent
Pillichshammer et al.

(10) Patent No.: US 11,873,580 B2
(45) Date of Patent: Jan. 16, 2024

(54) PROCESS FOR LIQUID REMOVAL FROM CELLULOSE FILAMENTS YARNS OR FIBERS

(71) Applicant: LENZING AKTIENGESELLSCHAFT, Lenzing (AT)

(72) Inventors: Johann Pillichshammer, Frankenmarkt (AT); Christoph Schrempf, Bad Schallerbach (AT); Andreas Gressenbauer, Schorfling am Attersee (AT); Ernst Reiter, Schorfling am Attersee (AT); Martin Neunteufel, Lantau Island (CN)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 384 days.

(21) Appl. No.: 17/417,957

(22) PCT Filed: Dec. 20, 2019

(86) PCT No.: PCT/EP2019/086559
§ 371 (c)(1),
(2) Date: Jun. 24, 2021

(87) PCT Pub. No.: WO2020/136109
PCT Pub. Date: Jul. 2, 2020

(65) Prior Publication Data

US 2022/0081803 A1 Mar. 17, 2022

(30) Foreign Application Priority Data

Dec. 28, 2018 (EP) ..... 18248174

(51) Int. Cl.
*D01D 10/06* (2006.01)
*D01D 5/06* (2006.01)
*D01F 2/02* (2006.01)

(52) U.S. Cl.
CPC ..... *D01D 10/06* (2013.01); *D01D 5/06* (2013.01); *D01F 2/02* (2013.01)

(58) Field of Classification Search
CPC ..... D01D 10/06; D01D 5/06; D01D 5/0069; D01D 5/16; D01F 2/02; D01F 2/00
See application file for complete search history.

(56) References Cited

U.S. PATENT DOCUMENTS 2,895,790 A 7/1959 Russell et al.
3,057,038 A 10/1962 Soehngen
(Continued)

FOREIGN PATENT DOCUMENTS

CA 1135918 A 11/1982
CN 1501990 A 6/2004
(Continued)

OTHER PUBLICATIONS

Peng et al, Effect of Spinning Processing on the Performance of Lyocell High Molecular Weight Cellulose Fiber, Journal of Donghua University, vol. 29, No. 2, pp. 83-87 (2003).
(Continued)

*Primary Examiner* — Nahida Sultana
(74) *Attorney, Agent, or Firm* — Venable LLP

(57) ABSTRACT

The present invention provides a process for the viable removal of liquid from lyocell cellulose continuous filament yarns at very high production speeds.

12 Claims, 1 Drawing Sheet

(56) References Cited

U.S. PATENT DOCUMENTS

| | | | | |
|---|---|---|---|---|
| 4,164,841 | A | 8/1979 | Borenstein et al. | |
| 4,246,221 | A | 1/1981 | McCorsley, III | |
| 5,238,534 | A | 8/1993 | Manning et al. | |
| 5,589,125 | A | 12/1996 | Zikeli et al. | |
| 5,725,821 | A | 3/1998 | Gannon et al. | |
| 5,863,478 | A | 1/1999 | Ruf et al. | |
| 5,868,985 | A | 2/1999 | Frischmann | |
| 6,042,769 | A * | 3/2000 | Gannon | D01F 2/00 264/203 |
| 6,159,601 | A | 12/2000 | Pitowski et al. | |
| 6,190,596 | B1 | 2/2001 | Budgell et al. | |
| 2002/0037411 | A1 | 3/2002 | Frankfort et al. | |
| 2013/0101843 | A1 | 4/2013 | Kim et al. | |
| 2013/0157054 | A1 | 6/2013 | Chitrangad | |
| 2017/0121857 | A1 | 5/2017 | Jeong et al. | |
| 2021/0062369 | A1* | 3/2021 | Klaus-Nietrost | D01F 2/00 |
| 2023/0083348 | A1* | 3/2023 | Sagerer-Foric | D01D 5/0985 442/400 |

FOREIGN PATENT DOCUMENTS

| | | | |
|---|---|---|---|
| CN | 102477591 | A | 5/2012 |
| CN | 106164346 | A1 | 11/2016 |
| DE | 2844163 | A1 | 5/1979 |
| DE | 19954152 | A1 | 7/2000 |
| EP | 0823945 | A1 | 2/1998 |
| EP | 0853146 | A2 | 7/1998 |
| GB | 703613 | A1 | 2/1954 |
| GB | 762959 | A1 | 12/1956 |
| GB | 787560 | A1 | 12/1957 |
| GB | 787563 | A1 | 12/1957 |
| GB | 1335473 | A1 | 10/1973 |
| JP | 2010255159 | A | 11/2010 |
| WO | 97/33020 | A1 | 9/1997 |
| WO | 98/06754 | A1 | 2/1998 |

OTHER PUBLICATIONS

Krüger et al., "Cellulosic Filament Yarn from the NMMO Process", Lenzinger Berichte Sep. 1994, pp. 49-53.

* cited by examiner

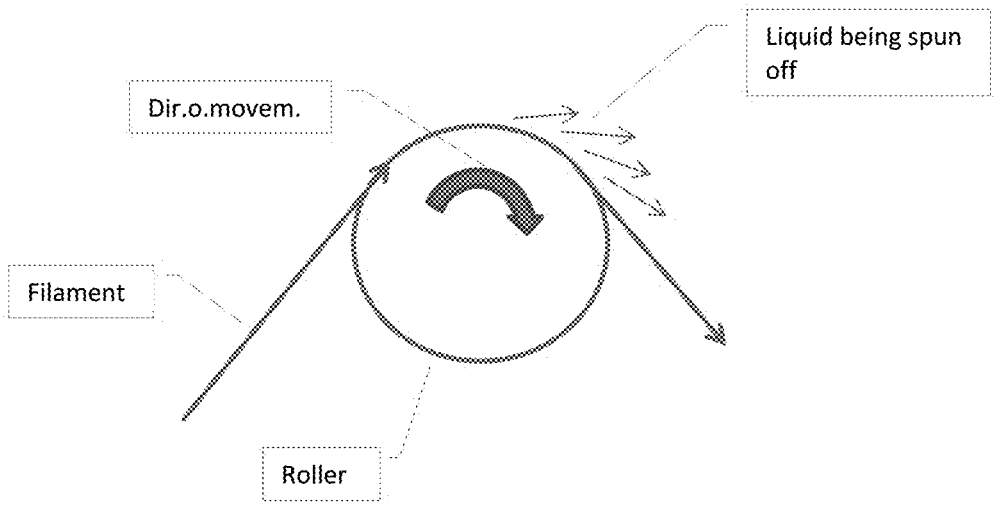
Liquid being spun off
Dir.o.movem.
Filament
Roller

PROCESS FOR LIQUID REMOVAL FROM CELLULOSE FILAMENTS YARNS OR FIBERS

The present application is a national-stage entry under 35 U.S.C. § 371 of International Patent Application No. PCT/EP2019/086559, published as WO 2020/136109 A1, filed Dec. 20, 2019, which claims priority to EP 18248174.7, filed Dec. 28, 2018, the entire disclosure of each of which is hereby incorporated by reference.

The present invention relates the production of cellulose filament yarns or fibers, namely to process steps within a production process relating to dewatering (such as removal of washing liquid/coagulation bath residues etc.).

BACKGROUND OF THE INVENTION

Continuous filament yarns are widely used in the textile industry to produce fabrics with a distinct character compared to fabrics produced from yarns made using staple fibers. A continuous filament yarn is one in which all of the fibers are continuous throughout any length of the yarn. A continuous filament yarn will commonly consist of 10 to 300 or more individual filaments which are all parallel to each other and the axis of the yarn when produced. The yarn is produced by extruding a solution or melt of a polymer or a polymer derivative and then winding the yarn produced onto a bobbin or reel or by forming a cake by centrifugal winding.

Synthetic polymer continuous filament yarns are common. For example, nylon, polyester and polypropylene continuous filament yarns are used in a wide variety of fabrics. They are produced by melt spinning a molten polymer through a spinneret with a number of holes corresponding to the number of filaments required in the yarn produced. After the molten polymer has started to solidify, the yarn may be drawn to orient the polymer molecules and improve the properties of the yarn.

Continuous filament yarns can also be spun from cellulose derivatives such as cellulose diacetate and cellulose triacetate by dry spinning. The polymer is dissolved in a suitable solvent and then extruded through a spinneret. The solvent evaporates quickly after extrusion causing the polymer to precipitate in the form of filaments forming a yarn. The newly produced yarn may be drawn to orient the polymer molecules.

Continuous filament yarns can also be produced from cellulose using the viscose process. Cellulose is converted to cellulose xanthate by reaction with sodium hydroxide and carbon disulphide and then dissolved in a sodium hydroxide solution. The cellulose solution, commonly called viscose, is extruded through a spinneret into an acid bath. The sodium hydroxide is neutralised causing the cellulose to precipitate. At the same time, the cellulose xanthate is converted back to cellulose by reaction with the acid. The newly formed filament is drawn to orient the cellulose molecules, washed to remove reactants from the filament and then dried and wound onto a bobbin. In earlier versions of this process, the wet yarn was collected into a cake using a centrifugal winder—a Topham Box. The cake of yarn was then dried in an oven before winding onto a bobbin.

Continuous filament cellulose yarns are also produced using the cupro process. Cellulose is dissolved in a solution of cuprammonium hydroxide. The resulting solution is extruded into a water bath where the cuprammonium hydroxide is diluted and the cellulose precipitates. The resulting yarn is washed, dried and wound onto a bobbin.

Cellulosic continuous filament yarn produced by either the viscose or the cupro process can be made into fabrics by weaving or knitting or other fabric forming processes. Fabrics produced are used for a variety of applications including linings for outerwear, ladies blouses and tops, lingerie and prayer rugs. Yarns are also produced for use in the reinforcement of tyres and other rubber products.

Fabrics made from continuous filament cellulose yarns can have a high lustre. They are good at moisture handling to enhance the comfort of the wearer. They do not generate static electricity as readily as fabrics made using continuous filament synthetic yarns.

However, fabrics made from currently available continuous filament cellulose yarns generally have poor physical properties. The dry strength and the tear strength are poor compared to fabrics made from synthetic polymers such as polyester. The wet strength is much lower than the dry strength due to interactions between the cellulose and water. The abrasion resistance is low. The interactions with water also soften the cellulose causing the fabrics made from the yarn to be unstable when wetted.

Due to these deficiencies, the products which were originally made using continuous filament cellulose yarns are now mainly produced using synthetic polymer continuous filament yarns such as polyester and nylon.

However, synthetic yarns do show certain drawbacks. Fabrics made using them do not have the moisture handling capability of fabrics made from cellulose yarns. Synthetic fabrics can generate static electricity. Some people consider garments made from synthetic yarns much less comfortable to wear compared with cellulose containing fabrics.

Accordingly there is a need for continuous filament cellulose yarns which would allow to produce fabrics and other textile products that have the positive characteristics of currently available fabrics made from continuous filament cellulose yarns but with the performance usually associated with fabrics made using continuous filament synthetic yarns.

It has surprisingly been found that continuous filament yarns produced by the lyocell process have considerably higher tensile strength than filament yarns produced by the viscose process. This can result in fabrics with better strength, tear strength and abrasion resistance. The loss of strength when lyocell filaments are wetted is much lower than for viscose filaments. This means that lyocell fabrics are more difficult to deform when wet giving better fabric stability. Lyocell fabrics are also stronger when wet compared to equivalent viscose fabrics.

It has also been surprisingly found that fabrics produced from lyocell continuous filaments can have the lustre, moisture handling properties and low static generation that are the desirable characteristics of continuous filament viscose and cupro fabrics.

Lyocell technology is a technology based on the direct dissolution of cellulose wood pulp or other cellulose-based feedstock in a polar solvent (for example n-methyl morpholine n-oxide, hereinafter referred to as 'amine oxide') to produce a viscous highly shear-thinning solution which can be formed into a range of useful cellulose-based materials. Commercially, the technology is used to produce a family of cellulose staple fibers (commercially available from Lenzing AG, Lenzing, Austria under the trademark TENCEL®) which are widely used in the textile and nonwovens industries. Other cellulose products from lyocell technology such as filaments, films, casings, beads & nonwoven webs have also been disclosed.

EP 823945 B1 discloses a process for the manufacture of cellulose fibers, which comprises the extrusion and coagulation of a cellulose spinning solution in accordance with the lyocell process and drawing the filaments and cutting the filaments into cellulose fibers, which may be used in various fields of application. EP 0 853 146 A2 discloses a process for the preparation of cellulosed based fibers. According to the teaching of this document two different raw materials having widely differing molecular weights are mixed in order to obtain fibers. WO 98/06754 discloses a similar method, which require that the two different raw materials are first dissolved separately, before admixing the prepared solution to obtain a spinning solution. DE 199 54 152 A1 discloses a method of preparing fibers, wherein spinning solutions having a relatively low temperature are employed.

The benefits of cellulose filament yarns produced from lyocell spinning solution have been described (Krüger, Lenzinger Berichte 9/94, S. 49 ff.). However, due to increasing demands regarding spinning efficiency, attempts have been made to increase spinning speeds in the lyocell process to values of several hundred meters per minute.

In addition, even at high production speeds it is important that the filaments/yarns/fibers produced are adequately washed, i.e. undesired residual amounts of processing materials, such as solvents or other additives which are not required to remain in the material produced, are removed as much as possible. In this regard, a typical lyocell process comprises an initial step to remove residual amounts of coagulation bath as well as subsequent washing steps. During these steps there are various options to remove liquids from the filaments/yarns/fibers, which are employed in the art. Typical means fro liquid removal often involve the use of devices which exert a certain mechanical force on the filaments/yarns/fibers, for examples devices for wiping off, stripping off or to squeeze of liquid. However, due to the increased demand for high production speeds, such means for removal of liquid are often no longer suitable, as these may lead to high rate of defects. Accordingly, the required high spinning and production velocities, while of course maintaining filament quality, present the drawback that reliable and generally usable, and commercially viable means for removal of liquid are not yet known, as prior art teachings regarding fiber and filament production from other process technologies (viscose, synthetic filaments) are not applicable to lyocell processes due to the demanding requirements of high polymer extension directly after extrusion followed by controlled solvent removal via liquor exchange.

The preparation of continuous filament lyocell yarns at high velocities therefore presents new process challenges, primarily due to much higher production speeds, filament uniformity requirements and the need for exceptional process continuity:

Filament production speeds in excess of ten times faster than for staple fiber production are typical and the recent demands to further increase productions speeds increase the problems of process control.

In a continuous filament yarn product, properties of all individual filaments must be within a very narrow window of variability, for example to prevent problems such as variation in uptake of dye. For example, a coefficient of variance of denier distribution must be less than 5%. On the other hand, in a staple fiber process, there is much more scope for 'averaging out' of minor variations between individual filaments because each bale of fibers consists of several million individual fibers obtained from filaments which have been cut to required length and blended. An example of the formation of lyocell staple fibers is disclosed in EP 823 945 B1.

OBJECT OF THE INVENTION

Accordingly it is the object of the present invention to provide a process enabling the reliable liquid removal from lyocell filaments and of lyocell multifilament yarns with a high quality at very high production speeds with a process control making the overall process commercially viable.

BRIEF DESCRIPTION OF THE INVENTION

Accordingly, the present invention provides the process as defined in claim 1. Preferred embodiments are given in claims 2 to 10 and the specification.

BRIEF DESCRIPTION OF THE FIGURE

FIG. 1 shows a schematic representation of the process step disclosed herein.

DETAILED DESCRIPTION OF THE INVENTION

The limitations of the state of the art have been overcome by the invention disclosed herein. Namely the present invention provides a process for liquid removal from lyocell filaments and lyocell multifilament yarns as defined in claim 1. The present invention will be described in detail referring to the required process control in relation to the relevant process steps and parameters to be employed. It is to be understood, that these process steps and their respective preferred embodiments can be combined as appropriate and that the present application covers these combinations and discloses same, even if not explicitly described herein.

The inventors have determined, that for productions velocities of 400 m/min or more a desired process control, enabling a good liquid removal from a filament bundle or multifilament yarn can be achieved, without requiring the use of wiping, squeezing or stripping devices, if the filament bundle or multifilament yarn is guided around a roller under specific conditions. These conditions ensure that a vast amount of liquid is removed from the bundle/yarn, even if entrapped in between different filaments within the bundle/yarn or within the filament itself. This is important, as the efficacy of any washing process requires that not only undesired materials are removed from the surface of the filaments but also from within the filament. This requires a good removal of as much liquid as possible, for the initial removal of coagulation bath liquid to any subsequent removal of washing liquid (typically water). Only if a very high proportion of the washing liquid remaining with the filament bundle/yarn, after contact with the washing liquid, is removed, can subsequent washing steps achieve the required further purification of the product. Accordingly it is essential that the liquid removal is as efficient as possible, while not affecting the filaments formed.

Namely, for the high production velocities required (400 m/min or more) the present invention provides a means for efficient liquid removal for filament bundles/yarns of at least 40 dtex, by adjusting the specific acceleration (a_sp) of the filaments being guided around a roller to at least 296 $m/s^2$ per 40 dtex. This specific acceleration can be described by the following equation (1):

$$a_sp = r \times \omega^2 \times \text{titer}/40 \quad (1)$$

with r being the radius of the roller (m), ω being the angular speed (1/s), and titer (dtex) being the bundle/yarn titer, with the proviso that same is at least 20. Accordingly, suitable process conditions for any given titer and production speed (which relates to the angular speed) can be determined by appropriately selecting the variables so that the liquid removal process is carried out under conditions satisfying the equation above.

It has been found unexpectedly that by adjusting the process parameters as indicated above, a highly efficient liquid removal can be ensured. In this regard it has been found that the process as described herein is applicable at production speeds of 400 m/min or more, in particular for production speeds of from 400 to 2000 m/min. Even at such high production speeds, which require high speed transfer of the filament bundles/yarns around the roller for liquid removal, no detrimental effect is asserted on the produced filaments. However, the desired efficient removal of liquid is obtained, as long as the equation above is satisfied.

In accordance with the present invention it is preferred that the radius of the roller around which the filament bundles/yarns are guided is in the range of from 10 to 200 mm, preferably 12.5 to 150 mm. The titer of the filament bundle/yarn is preferably in the range of from 20 (the required minimum titer) to 500 dtex, more preferably in the range of from 40 to 400 dtex.

In addition, it has been determined, that it is advantageous of the filament bundle/yarn is in contact with at least 12.5% of the roller circumference (45°), more preferably with at least 25% (90°). This ensures that the filament bundle/yarn is in contact with the roller surface for a time long enough so that a high amount of liquid moves from the inside of the filaments or the filament bundle/yarn to the outside thereof, so that it is then spun away (catapulted/centrifuged away).

Accordingly, the present invention provides an efficient way to remove liquid from filament bundles/yarns even at high production speeds, by providing a correlation between production speed, bundle/yarn titer and roller radius to enable efficient and simple liquid removal.

The teaching of the present invention may be employed for the initial removal of coagulation bath liquid and/or for any subsequent removal of washing liquid. In accordance with the present invention one or more rollers for liquid removal as described herein may be present in a process for the production of lyocell multifilament yarns, with or without additional washing steps (i.e. new contact with washing liquid) between two rollers for liquid removal.

The type of roller is not critical, including surface material etc., as long as the rollers enable the guidance of the filament bundles/yarns around the roller at the given production speed as explained above. Usual rollers employed in the lyocell process may be used. The roller speed is typically about the same as the speed of the filament bundle/yarn and the rollers may comprise means for generation of roller movement (driven roller) or the filament movement generates the roller movement. The term that the roller speed and the filament speed are substantially the same in accordance with the present invention means that the speeds are within ±10% of each other, more preferably within ±5%. As regards filament tension it has been found advantageous if same is 2 cN or more. The following examples illustrate the present invention further:

Multifilament yarns from a lyocell filament spinning process were subjected to a liquid removal step after contact with washing water in accordance with the present invention. The following table summarizes the relevant process parameters (v being the production speed). The entry "A" designates that no problems/defects were detected after the liquid removal and that in addition a high proportion of liquid in fact was removed from the filament bundle/yarn.

| | | | Titer (dtex) | | |
|---|---|---|---|---|---|
| V (m/min) | r (m) | ω (1/s) | 40 evaluation | 80 evaluation | 300 evaluation |
| 400 | 0.0125 | 533 | A | A | A |
| 700 | 0.0125 | 933 | A | A | A |
| 1000 | 0.0125 | 1333 | A | A | A |
| 400 | 0.074 | 90 | A | A | A |
| 700 | 0.074 | 158 | A | A | A |
| 1000 | 0.074 | 225 | A | A | A |
| 400 | 0.15 | 44 | A | A | A |
| 700 | 0.15 | 78 | A | A | A |
| 1000 | 0.15 | 111 | A | A | A |

The invention claimed is:

1. A process for the removal of liquid from lyocell type cellulose filament bundles or yarns from a lyocell spinning solution of cellulose in an aqueous tertiary amine oxide, wherein the lyocell type cellulose filament bundles or yarns are guided around a roller under conditions so that equation (1) is fulfilled, with the proviso that a_sp is at least 296 m/s$^2$:

$$a_sp = r \times \omega^2 \times \text{titer}/40 \quad (1)$$

with r being the radius of the roller (m), ω being the angular speed (1/ s), and titer (dtex) being the bundle/yarn titer, with the proviso that same is at least 20.

2. The process according to claim 1, wherein r is from 0.010 to 0.200 m.

3. The process according to claim 1, wherein the titer is from 20 to 400 dtex.

4. The process according to claim 1, wherein the roller is a driven roller.

5. The process according to claim 1, wherein the roller is driven by the filament movement.

6. The process according to claim 1, wherein the lyocell type cellulose filament bundles or yarns are in contact with at least 12.5% of the circumferential surface of the roller (45°).

7. The process according to claim 1, wherein two or more rollers for liquid removal are provided without intermittent steps of contacting the lyocell type cellulose filament bundles or yarns with fresh washing liquid.

8. The process according to claim 1, wherein two or more rollers for liquid removal are provided with intermittent steps of contacting the lyocell type cellulose filament bundles or yarns with fresh washing liquid.

9. The process according to claim 1, wherein the filament tension during the removal of liquid is 2 cN per filament or more.

10. The process according to claim 1, wherein the filament tension during the removal of liquid is 0.4 cN/dtex or less.

11. The process according to claim 2, wherein r is from 0.0125 to 0.150 m.

12. The process according to claim 6, wherein the lyocell type cellulose filament bundles or yarns are in contact with at least 25% of the circumferential surface of the roller(90°).

* * * * *